US005542353A

United States Patent [19]

Cuir et al.

[11] Patent Number: 5,542,353

[45] Date of Patent: Aug. 6, 1996

[54] PROCESS AND INSTALLATION FOR SHEET-BY-SHEET PRINTING

[75] Inventors: Jean-Pierre Cuir; Gérard Cuir, both of Villeneuve D'Ascq; Raymond Barsamian, Neuville Saint Vaast, all of France

[73] Assignee: Cuir (S.A.), France

[21] Appl. No.: 356,876

[22] Filed: Dec. 15, 1994

[30] Foreign Application Priority Data

Jan. 3, 1994 [FR] France ..... 94 0093

[51] Int. Cl.[6] ..... B41F 13/00; B41F 3/58

[52] U.S. Cl. ..... 101/492; 101/217

[58] Field of Search ..... 101/216, 217, 101/142, 484, 483, 485, 486, 492, 218, 177, 144

[56] References Cited

U.S. PATENT DOCUMENTS 2,022,696 12/1935 Tomlin et al. ..... 270/5
2,619,901 12/1952 Harrold ..... 101/177
3,287,712 11/1966 Chambon ..... 101/350
4,373,442 2/1983 Dahlgren et al. ..... 101/207
4,445,433 5/1984 Navi ..... 101/350

FOREIGN PATENT DOCUMENTS 2852391 1/1981 United Kingdom .

*Primary Examiner*—J. Reed Fisher
*Attorney, Agent, or Firm*—Ladas & Parry

[57] ABSTRACT

In the sheet-by-sheet printing process, a sheet is printed during its passage in the nip zone between a printing cylinder, which comprises on its periphery a rubber element, and an impression cylinder. The ink is supplied to the printing cylinder by an ink supply cylinder. In order to reduce the deformations of the printing dots, the ratios of the peripheral linear speeds of the ink supply cylinder and of the impression cylinder with respect to the peripheral linear speed of the rubber element of the printing cylinder are adjusted to values in the range of 1.004 to 1.05.

8 Claims, 3 Drawing Sheets

PROCESS AND INSTALLATION FOR SHEET-BY-SHEET PRINTING

FIELD OF THE INVENTION

The present invention relates to an improved process for the sheet-by-sheet printing, of flexographic or possibly offset type, of semi-rigid materials such as corrugated cardboard or paper in which the ink is supplied onto the sheet with the aid of a rubber element mounted on the periphery of a printing cylinder. It relates more particularly to an improved process eliminating the deformations of the printing dots due to the non-controlled crushing of the rubber element. It also concerns a sheet-to-sheet printing installation especially designed to carry out the above process.

BACKGROUND OF THE INVENTION

Installations of flexographic type comprise a screened cylinder, a plate cylinder, an impression system and a transfer system which feeds the sheets one by one between the plate cylinder and the impression system. The plate, which is mounted on the plate-cylinder, is a rubber element adapted to receive the ink which is transferred thereto by the screened cylinder and to apply it on the sheet to be printed during passage thereof in the nip zone between the plate cylinder and the impression system.

Installations of offset type comprise a plate cylinder, a so-called blanket cylinder and an impression cylinder. The blanket cylinder is coated on its periphery with a rubber element which is adapted to receive the ink transferred thereto by the plate cylinder to apply it on the sheet to be printed during passage thereof in the nip zone between the blanket cylinder and the impression cylinder.

In these two types of sheet-by-sheet printing process, there is a rubber element which is mounted on a first printing cylinder and which is applied, on the one hand, on a second ink supply cylinder and, on the other hand, via the sheet to,be printed, on an impression cylinder.

In theory, to effect transfer of the ink from the second cylinder onto the rubber element of the first impression cylinder, it is not necessary to exert a particular pressure between these two cylinders; it suffices that the ink lying on the surface of the second cylinder be to some extent touched by the outer face of the rubber element of the first printing cylinder. This is called "kiss impression".

In practice, it is necessary to exert such pressure due to the irregularities which-may exist in the thickness of the rubber element, particularly if it is question of flexographic printing plates, or due to the lack of straightness of the outer surface of one or the other of the cylinders. In fact, if such a pressure were not exerted, these different irregularities would be translated by variations in intensity of the print, going as far as forming non-printed zones.

The crushing of the rubber element, on the periphery of the first printing cylinder, provoked by the application of this pressure, avoids such shortcomings.

The same applies concerning the application of a pressure between the first printing cylinder and the impression cylinder, via the sheet to be printed.

Furthermore, to obtain optimum functioning of the print, aiming at eliminating any possible slide between the different cylinders which are applied against one another, it is usual to adapt adjustments aiming at obtaining a perfect equality between the peripheral linear speeds of the different cylinders as well as of the transfer system feeding the sheets to be printed.

However, Applicants have observed that, even when they adjust rotation of the different cylinders so as to obtain a perfect equality of the peripheral linear speeds of said cylinders, they did not obtain a perfect print. More precisely, this observation was made on examining the printing dots in flexography. In fact, being question of a theoretically circular printing dot, it is found on the printed sheet in a substantially oval form, with a really printed surface which is therefore greater than the theoretical surface, sometimes greater by 60% than this surface.

It is an object of the invention to propose a sheet-by-sheet printing process which overcomes this abnormal deformation of the printing dot, while making it possible to work with a crushing of the rubber element.

SUMMARY OF THE INVENTION

This object is perfectly achieved by the process of the invention, which is a sheet-by-sheet printing process wherein, in known manner, a sheet is printed during its passage in the nip zone between a first printing cylinder which comprises on its periphery a rubber element and an impression system, the ink being supplied to the first printing cylinder by a second ink supply cylinder, In characteristic manner, in order to reduce the deformations of the printing dots, the process consists in adjusting the ratios of the peripheral linear speeds of the second ink supply cylinder and of the impression cylinder with respect to the peripheral linear speed of the rubber element of the first printing cylinder, to values constantly greater than 1, included within the range 1.004 to 1.05.

Applicants have, in fact, quite unexpectedly observed that, contrary to what was normally recommended, it sufficed to increase in certain proportions the peripheral linear speed of the second ink supply cylinder and of the impression cylinder with respect to the peripheral linear speed of the rubber element to obtain a reduction in the defect observed, with the possibility of obtaining, in practice, the theoretical surface of the printing dot.

The values of the ratios of speeds included within the range recommended, namely from 1.004 to 1.05, well exceed what is theoretically provided to compensate the reduction in thickness due to the crushing of the rubber element. There is therefore a noteworthy difference in speed between the first printing cylinder and the other two cylinders, which difference, up to the present time, would have been considered as detrimental, Inventors verified that, on the contrary, those differences in speeds made it possible to reduce, and even eliminate a printing defect, Applicants attempted to seek an explanation for this phenomenon. Crushing of the rubber element, during application of the pressure between the first printing cylinder and the other two cylinders, provokes a deformation of the rubber in the zones of contact; more precisely, when the cylinders are stationery, during application of the effort, this deformation is translated by the formation of two beads of matter on either side of the zones of contact. When the cylinders are rotating, with the same peripheral linear speed, there is produced, due to the frictions coming into play between the surfaces in contact, a phenomenon of creeping of the rubber, tending to provoke an enlargement of the bead located upstream of the zone of contact with respect to the one located downstream, in the direction of rotation of the cylinders. Such enlargement is assumed to be the origin of the increased surface of the printing dot.

Implementation of the process of the invention would make it possible, by increasing the peripheral linear speed of the cylinders in contact with the rubber element, to thwart the enlargement of the upstream bead by a complementary deformation giving rise to a downstream bead again. However, too great an increase in speed would create a shortcoming in the opposite sense, namely an excessive enlargement of the downstream bead and the total disappearance of the upstream bead.

Applicants are seeking to obtain, during printing, a deformation of the rubber element which is similar to what is obtained when the cylinders are stationary.

Advantageously, the cylinders being adapted to be driven in rotation independently of one another, the speed ratios are adjusted automatically, for a given rubber element, as a function of the crushing thereof.

Thanks to multiple trials, Applicants have, in fact, observed that the speed ratios to obtain the desired effect were directly a function of the crushing of the rubber element, i.e. the difference in thickness in the tangent line between the two cylinders.

The cylinders being adapted to be driven in rotation independently of one another, the speed ratios-are preferably automatically adjusted so as to obtain minimum electrical consumption for the drive motor of the first printing cylinder.

This preferred mode of controlling the speed ratios is based on a new observation made by the Applicants, concerning the instantaneous electric consumption of the motors driving the cylinders. In fact, if it is considered that, to obtain a given peripheral linear speed of rotation, the motors deliver a predetermined electrical intensity when there is no contact therebetween, this intensity increases very substantially when the rubber element is applied on the surface of the other cylinder. When carrying out the process of the invention, following the instantaneous intensity of each motor, Applicants have observed that there was a minimum threshold for this increase in intensity and that this threshold corresponded to the optimum adjustment of the speed ratios.

It is another object of the invention to propose an installation for sheet-by-sheet printing especially designed to carry out the process described hereinbefore. This installation comprises, in known manner, a first printing cylinder having a rubber element on its periphery, a second ink supply cylinder and a third impression cylinder, each sheet to be printed being successively fed up to the nip zone between the first printing cylinder and the impression cylinder; said installation also comprises means for driving said three cylinders in rotation.

In characteristic manner, the drive means consisting of three mechanically independent motors or gear motors, the installation also comprises means for adjusting the speeds of rotation of the three determined cylinders so that the ratios of the peripheral linear speeds of the second ink supply cylinder and of the impression cylinder with respect to the peripheral linear speed of the rubber element of the first printing cylinder constantly have values greater than 1, included within the range 1.004 to 1.05.

The installation preferably comprises means for adjusting the pressure of the second and third cylinders against the rubber element of the first printing cylinder and said adjustment means are themselves connected to the means for adjusting the speeds of rotation of the cylinders so as to allow adjustment of the speed ratios, for a given rubber element, as a function of the values of pressure of the cylinders against one another.

Preferably, at least the drive motor of the first printing cylinder is provided with means for measuring the instantaneous intensity of said motor, said control means themselves being connected via an appropriate electronic circuit to the means for adjusting the speed of rotation of the second and third cylinders.

BRIEF DESCRIPTION OF THE DRAWINGS

The invention will be more readily understood on reading the following description of an embodiment of an installation for sheet-by-sheet printing of the flexographic type, illustrated in the .accompanying drawings, in which.

DESCRIPTION OF PREFERRED EMBODIMENT

Figure 4:
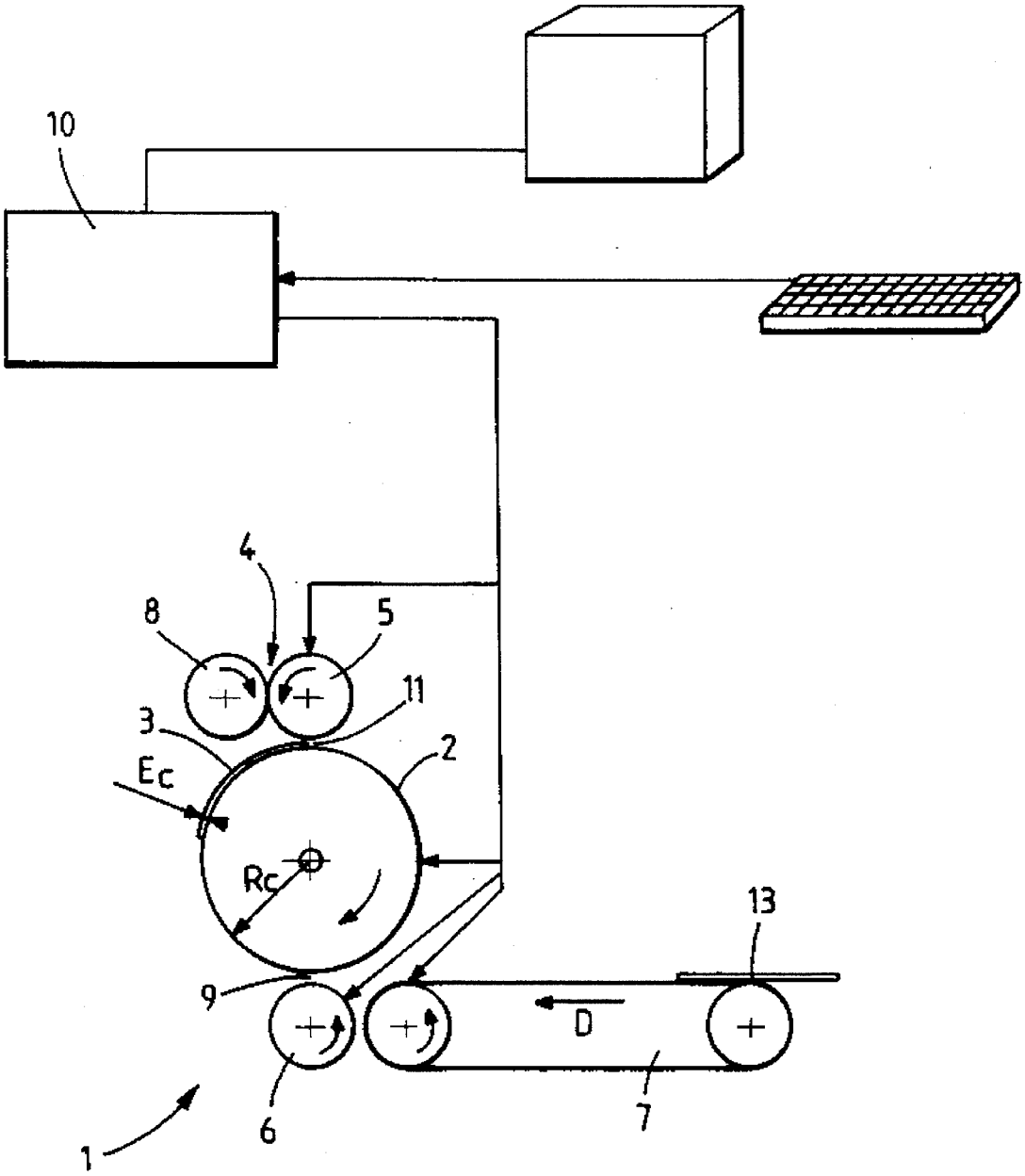
FIG. 4 schematically represents a complete installation with automatic adjustment for flexographic, sheet-by-sheet pointing.

Referring now to the drawings, the sheet-by-sheet printing installation 1, of flexographic type, which is shown in FIG. 4 comprises:

a plate-cylinder 2, on the periphery of which is mounted a plate 3, of thickness Ec, an inking system 4 comprising a screened cylinder 5, an impression cylinder 6, a transfer system 7, off synchronous belt type.

The surface of the screened cylinder 5 comprises a plurality of cells enabling it to receive the ink which is fed on the rubber cylinder 8 by means of a pump (not shown). During its rotation, the screened cylinder 5 allows inking of the plate 3, which represents the pattern to be printed.

The transfer system 7 allows transport of each sheet in the direction of arrow D up to the nip zone 9 between the impression cylinder 6 and the plate-cylinder 2.

The plate-cylinder 2, the screened cylinder 5, the transfer system 7 and the impression cylinder 6 are each driven by an individual motor with electronic servo-control, of the brushless motor type. All these motors are connected to an electronic circuit 10 for adjusting their respective speed.

Figure 1:
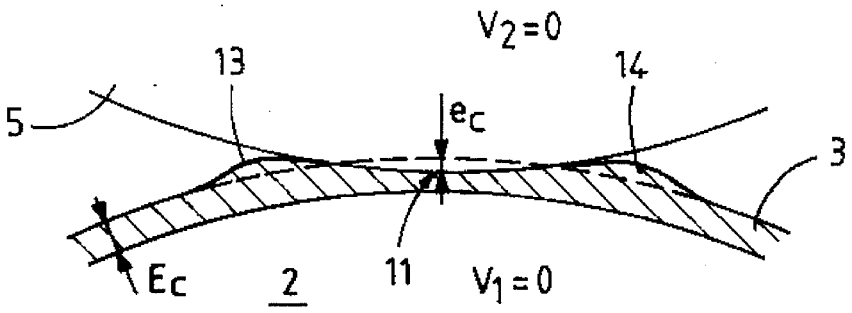
FIG. 1 schematically represents the screened cylinder and the plate-cylinder when stationary.
Figure 2:
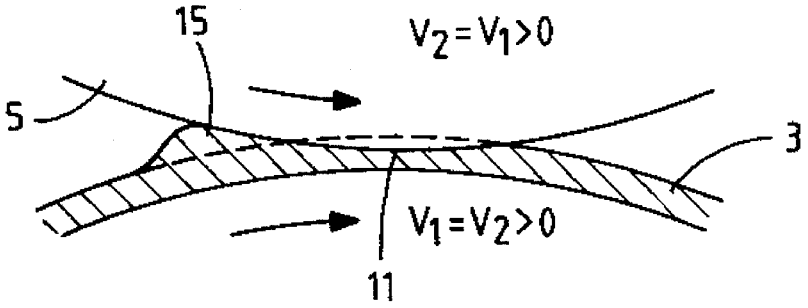
FIG. 2 schematically represents the screened cylinder and the plate-cylinder of FIG. 1 in normal operation, at identical peripheral linear speed.
Figure 3:
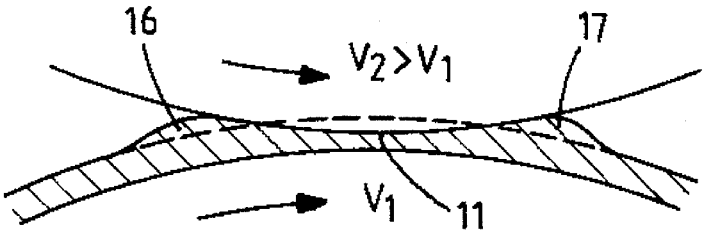
FIG. 3 schematically represents the screened cylinder and the plate-cylinder of FIG. 2, under the speed conditions of the invention.

FIGS. 1 to 3 represent the behaviour of the plate 3 during passage thereof in the zone of contact 11 between the screened cylinder 5 and the plate-cylinder 2.

In order to overcome the possible variations of different parameters and in particular the thickness of the plate 3, the straightness of the two cylinders 2, 5, the positioning of the plate 3 on the plate-cylinder 2, it is necessary to reduce the distance between the outer surface of the plate- and screened cylinders so that, upon passage of the plate 3 in the zone 11, a certain compression of said plate 3 is produced, making it possible to compensate said irregularities and to obtain a print on the whole of the sheet.

The plate 3 being an element made of rubber, such compression is translated by a deformation of the rubbery material.

FIG. 1 shows this deformation when the screened cylinder 5 and plate-cylinder 2 were stationary. The broken line illustrates the theoretical location of the plate 3 in the absence of the screened cylinder 5. On either side of the zone of contact 11 are observed lateral swells 13 and 14 in which is localized the excess of rubbery material which is pushed by the presence of the screened cylinder 5.

It is usual to provide, as respective adjustment of the speed of the different cylinders, that the peripheral linear speed of the screened cylinder 5 and impression cylinder 6 be strictly identical to the peripheral linear speed of the plate 3. The purpose of such adjustment is to avoid any slide between the different cylinders and also between the sheet 13 to be printed and the plate 3.

However, according to Applicants, when the peripheral linear speeds of the screened cylinder 5 and of the plate 3 are identical, a defective print is obtained. This defect is characterized by an ovalization of the printing dot which, in theory, should be circular. Such ovalization may increase the surface of the printed dot by up to 60%.

According to the characteristic of the process of the invention, this defect is corrected by significantly increasing the peripheral linear speed of the screened cylinder 5 with respect to that of the plate 3. Such increase is substantially included between 0.4 and 5%.

The optimum value of this increase in speed is a function of a certain number of parameters, such as the printing rate which is dependent on the speed of rotation of the plate-cylinder, the mechanical characteristics of the plate 3 and the crushing of the plate.

If V1 is considered the peripheral linear speed of the plate 3 and V2 that of the screened cylinder 5, the optimum ratio V2/V1 may be determined by successive trials, observing, for each trial, the shape and the surface of the printing dot; as the ratio increases beyond 1, said surface decreases then increases again. The ratio V2/V1 is optimum when this surface is minimum (which should be close to the theoretical surface of the printing dot).

According to Applicants, this is explained by the creep of the rubbery material during rotation of the cylinders.

FIG. 2 shows the deformation of the plate 3 when the speed ratio V2/V1 is equal to 1. Such deformation is translated by the presence of a considerable bead 13 of rubbery material upstream of the zone of contact 11 and the disappearance, or virtual disappearance, of the bead which existed previously downstream of said contact zone 11. This deformation would be due to the frictional forces coming into play on the surface of the plate 3 due to the contact with the periphery of the screened cylinder 5.

The ovalization of the printing dot may be explained by the correlative increase of the contact surface between the plate 3 and the screened cylinder 5.

The increase of the speed ratio V2/V1, in accordance with the process of the invention, makes it possible to correct this defect thanks to a contrary deformation of the rubbery mass. In fact, the increase in relative speed of the surface of the screened cylinder 5 makes it possible to thwart the effect due to the frictional forces between the two surfaces. According to Applicants, this would be translated by a new deformation in the form of two beads 16, 17 located respectively on either side of the contact zone 11. This deformation is substantially identical to that observed when the cylinders are stationary (FIG. 1).

The electronic circuit 10 is programmed to automatically servo-control the position of the brushless motors which drive the plate-cylinder 2, the screened cylinder 5 and the impression cylinder 6 respectively in rotation. This servo-control is effected so as to obtain the speed ratio in accordance with the process of the invention. This same electronic circuit 10 is connected to the system for adjusting the positioning of the different cylinders with respect to one another, which defines the pressure exerted between said cylinders during passage, on the one hand, of the plate 3 between the screened cylinder 5 and the plate-cylinder 2 and, on the other hand, during passage of the sheet 13 to be printed between the plate 3 and the impression cylinder 6. This pressure, for a given plate 3, is characteristic of the crushing of said plate, i.e. of the reduction in thickness Ec in the contact zone 11 (FIG. 1).

Figure 5:
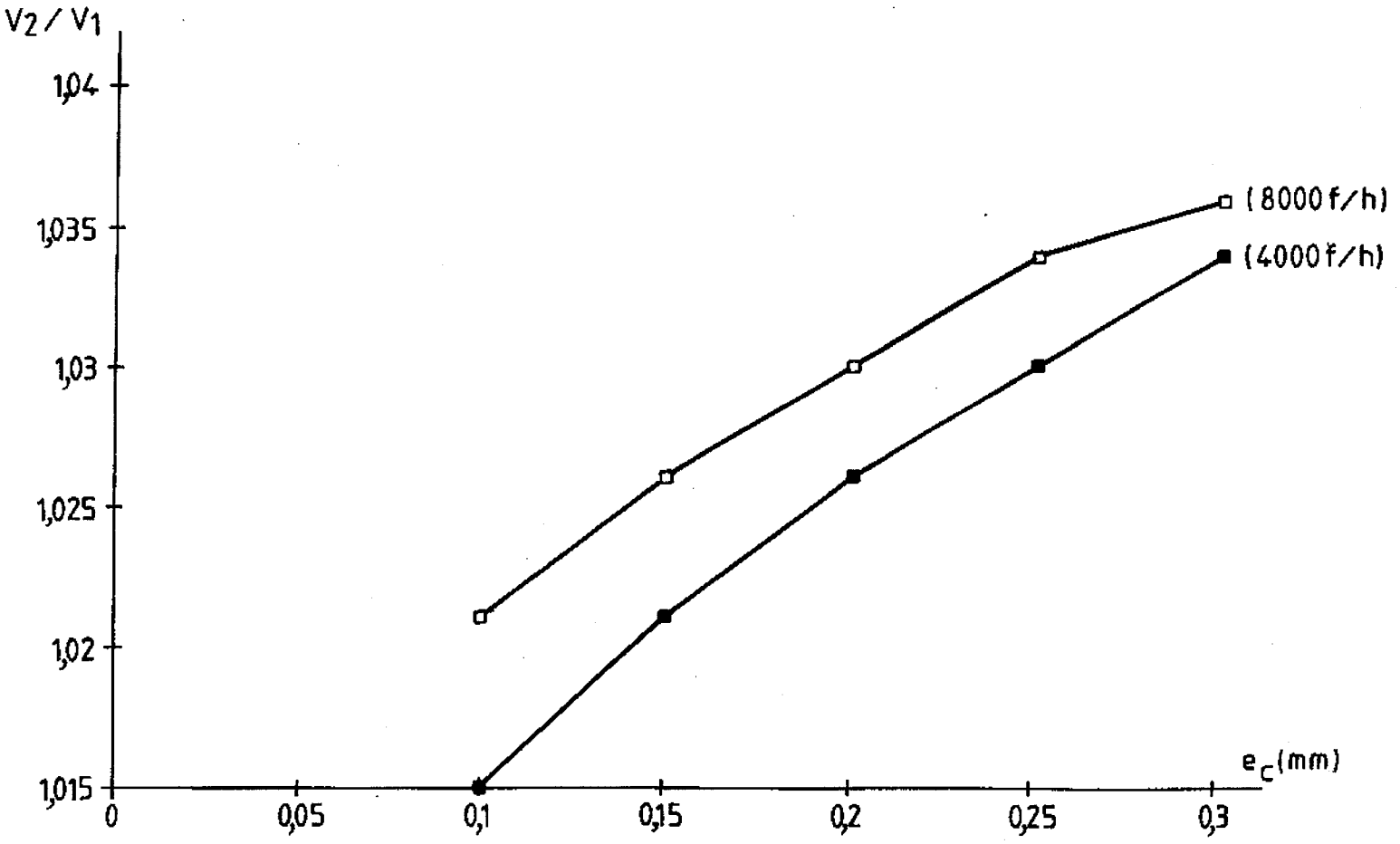
FIG. 5 is a curve showing the ratio of the speeds of rotation as a function of the crushing of the rubber element, at two given rates.

FIG. 5 shows examples of speed ratio values V2/V1 as a function of the crushing in millimeters of the plate 3 for two printing rates, namely 4000 sheets per hour and 8000 sheets per hour.

For the first rate and for a crushing of the order of 0.1 mm, which is a conventional adjustment, the speed ratio V2/V1 is of the order of 1.015, viz. an increase in the peripheral linear speed of the screened cylinder of 1.5% with respect to the peripheral linear speed of the plate 3.

It is possible to work with much greater crushings, of the order of 0.3 mm while obtaining an adequate .correction of the printing defect; in that case, it suffices to respect the speed ratio V2/V1 of the order of 1.034.

These values are substantially greater when the production rate is increased.

It is therefore remarkable that, thanks to the process of the invention, it is possible to work with very considerable crushings with respect to the conventional adjustment, while having an excellent quality of print. This is a considerable advantage insofar as Applicants have observed that the crushing of the plate 3 had an impact on the length of the print: the more the plate is crushed, the greater is the length of the print. It is therefore possible to make corrections in length of print by playing on the crushing of the plate, while conserving a very good quality of print.

All the foregoing indications have been given with the screened cylinder 5 being taken as reference. In fact, they are of the same order concerning the impression cylinder 6. The speed ratio must also be included within the range of 1.004 and 1.05.

The servo-control of the speeds of rotation effected by the electronic circuit 10 is preferably obtained by measuring one of the operational parameters of the motors driving said cylinders. It may be question of measuring the electrical intensity or of measuring the driving torque. The optimum ratio of the speed is that which corresponds-to the minimum of the corresponding parameter.

The installation can be controlled automatically after a pre-adjustment on the first sheets to be printed. To that end, it suffices to measure, for a speed ratio of 1, the variation of the intensity or of the driving torque upon passage of the plate between the screened cylinder 5 and the plate-cylinder 2 or upon passage of the sheet 13 between the plate 3 and the impression cylinder 6. The speed ratios are progressively increased while continuing to measure the variations of intensity or of driving torque. A comparison of the successive measurements makes it possible to determine the speed ratios which correspond to the minimum variations of intensity or of the driving torque.

The present invention is not limited to the embodiment which has just been described by way of non-limiting example.

In particular, the three cylinders are not necessarily equipped with independent motors of the brushless type or with gear motors. They may be driven by means of one motor with mechanical control, particularly by pinions or synchronous belts. In that case, it is necessary to determine a mean value of the speed ratios which make it possible to obtain a good-quality print for a determined crushing of the plate.

Furthermore, the process and installation are not limited to printing of the flexographic type, but are also applicable to offset printing.

What is claimed is:

1. A sheet-by-sheet printing process comprising the steps of printing a sheet when said sheet is passing in a nip zone between a printing cylinder, which includes a rubber element on its periphery, and an impression cylinder; supplying ink to said printing cylinder by an ink supply cylinder; adjusting and maintaining the ratios of the peripheral linear speeds of the ink supply cylinder and the impression cylinder with respect to the peripheral linear speed of the rubber element of the printing cylinder at values in the range of 1.004 to 1.05 so as to reduce the deformations of printing dots.

2. The process of claim 1, wherein the speed ratios are adjusted to a mean value for a determined crushing of the rubber element respectively with the impression cylinder and the ink supply cylinder, while the cylinders are driven in rotation by a motor with mechanical control by pinions.

3. The process of claim 1, wherein the speed ratios are adjusted to a mean value for a determined crushing of the rubber element respectively with the impression cylinder and the ink supply cylinder, while the cylinders are driven in rotation by a motor with mechanical control by synchronous belts.

4. The process of claim 1, wherein the speed ratios are adjusted for a given rubber element as a function of crushing thereof with the impression and ink supply cylinders, while the cylinders are driven in rotation independently of one another.

5. The process of claim 1, wherein the speed ratios are adjusted so as to obtain minimum electrical consumption for a drive motor of the printing cylinder, while the cylinders are driven in rotation independently of one another.

6. The process of claim 1, comprising the step of correlatively adjusting crushing of the rubber element with respect to the impression and ink supply cylinders in order to make corrections of length of print and conserve a good quality print.

7. An apparatus for sheet-by-sheet printing, comprising a printing cylinder having a rubber element on its periphery, an ink supply cylinder and an impression cylinder, each sheet to be printed being successively fed up to a nip zone formed between the printing cylinder and the impression cylinder, means for driving said three cylinders in rotation, said driving means including three mechanically independent motors, and means for adjusting the speeds of rotation of said three cylinders so that the ratios of the peripheral linear speeds of the ink supply cylinder and the impression cylinder with respect to the peripheral linear speed of the rubber element of the printing cylinder are maintained at values in the range of 1.004 to 1.05.

8. An apparatus for sheet-by-sheet printing, comprising a printing cylinder having a rubber element on its periphery, an ink supply cylinder and an impression cylinder, each sheet to be printed being successively fed up to a nip zone formed between the printing cylinder and the impression cylinder, means for driving said three cylinders in rotation, said driving means including three gear motors, and means for adjusting the speeds of rotation of said three cylinders so that the ratios of the peripheral linear speeds of the ink supply cylinder and the impression cylinder with respect to the peripheral linear speed of the rubber element of the printing cylinder are maintained at values in the range of 1.004 to 1.05.

* * * * *